US006390575B1

(12) United States Patent
Chen et al.

(10) Patent No.: US 6,390,575 B1
(45) Date of Patent: May 21, 2002

(54) TRACK DEVICE WITH SEPARABLE TRACKS

(75) Inventors: Geng-Jin Chen; I-Ming Tseng, both of Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/813,787

(22) Filed: Mar. 22, 2001

(51) Int. Cl.[7] ..... A47B 88/00
(52) U.S. Cl. ..... 312/334.46; 312/333
(58) Field of Search ..... 312/333, 334.44, 312/334.46, 334.47; 384/21

(56) References Cited

U.S. PATENT DOCUMENTS 5,248,195 A * 9/1993 Shin ..... 312/334.33
5,411,333 A * 5/1995 Hoffman ..... 384/21 X
5,577,821 A * 11/1996 Chu ..... 384/21 X
6,238,031 B1 * 5/2001 Weng ..... 312/333
6,257,683 B1 * 7/2001 Yang ..... 312/334.46 X

* cited by examiner

*Primary Examiner*—Janet M. Wilkens
(74) *Attorney, Agent, or Firm*—Bacon & Thomas, PLLC

(57) ABSTRACT

A track device comprises a first track and a second track. An engaging member is mounted to an end of the first rack and includes at least one leg and at least one operative wall. The first track further includes an upper longitudinal lip and a lower longitudinal lip. The second track is slidably received in the first track and guided between the upper longitudinal lip and the lower longitudinal lip. A pressing block and a resilient member are mounted to the second track. The pressing block includes a pressing leg and a shoulder. The pressing leg presses against an end of the resilient member. The end of the resilient member includes a tappet plate. Another end of the resilient member includes a pressing portion. The shoulder of the pressing block abuts against the leg of the first track. When the pressing portion of the resilient member is pressed, the tappet plate of the resilient member moves the leg such that the operative wall of the engaging member disengages from the shoulder of the pressing block, thereby allowing separation of the second track from the first track.

8 Claims, 5 Drawing Sheets

TRACK DEVICE WITH SEPARABLE TRACKS

BACKGROUND OF THE INVENTION

1. Field of the Invention

The present invention relates to a track device with separable tracks for easy assembly and detachment.

2. Description of the Related Art

FIG. 8 of the drawings illustrates a so-called "three-part" conventional track device for a drawer. The track device includes an outer track 91, a middle track 92, and an inner track 93. A plurality of rolling balls 94 are mounted between the middle track 92 and the inner track 93 to allow easy sliding movement of the inner track 93 in the middle track 92. In order to allow easy assembly, the inner track 93 has a claw 95 with a resilient leg 96 and the middle track 92 has a stop 97. The resilient leg 96 can be pressed to allow a protrusion 951 of the claw 95 to move across a stop piece 971 of the stop 97, thereby allowing assembly or detachment between the inner track 93 and the middle track 92. After the inner track 93 has been engaged in the middle track 92, the protrusion 951 of the claw 95 is engaged with the stop piece 971 of the stop 97 when the inner track 93 is pulled outward, thereby preventing disengagement of the inner track 93 from the middle track 92. The present invention is intended to provide a different design in this regard.

SUMMARY OF THE INVENTION

It is the primary object of the present invention to provide a track device with separable tracks for easy assembly and detachment.

A track device in accordance with the present invention comprises a first track and a second track. An engaging member is mounted to an end of the first rack and includes at least one leg and at least one operative wall. The first track further includes an upper longitudinal lip and a lower longitudinal lip. The second track is slidably received in the first track and guided between the upper longitudinal lip and the lower longitudinal lip. A pressing block and a resilient member are mounted to the second track. The pressing block includes a pressing leg and a shoulder. The pressing leg presses against an end of the resilient member. The end of the resilient member includes a tappet plate. Another end of the resilient member includes a pressing portion.

The shoulder of the pressing block abuts against the leg of the first track. When the pressing portion of the resilient member is pressed, the tappet plate of the resilient member moves the leg such that the operative wall of the engaging member disengages from the shoulder of the pressing block, thereby allowing separation of the second track from the first track.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

A preferred embodiment in accordance with the present invention will now be described with reference to the accompanying drawings.

Figure 1:
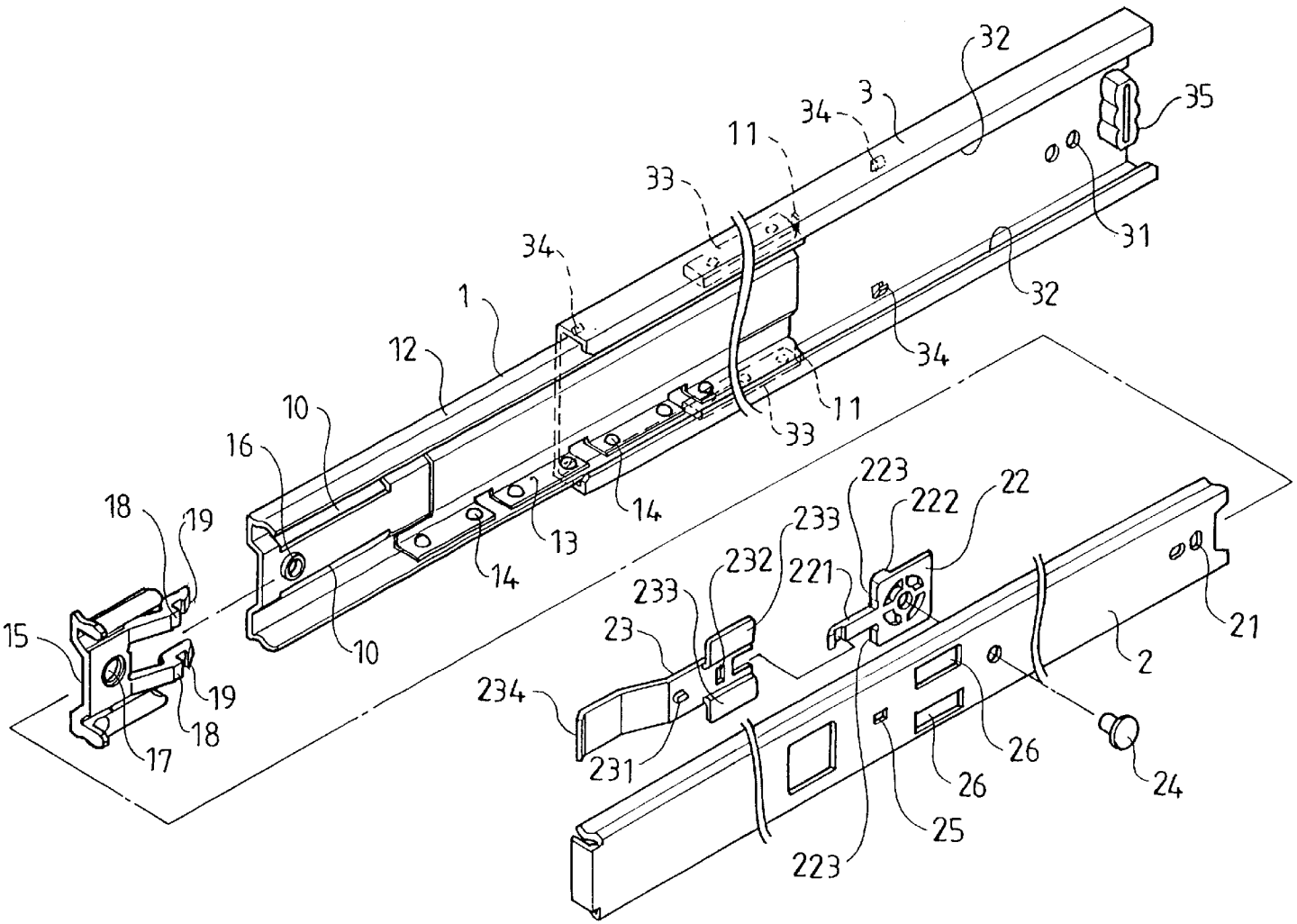
FIG. 1 is an exploded perspective view of a track device in accordance with the present invention.

Referring to FIG. 1, a three-part track device in accordance with the present invention generally includes a first track 1, a second track 2, and a third track 3. The first track 1 includes an upper longitudinal lip 12 and a lower longitudinal lip 12 for guiding sliding movement of the second track 2 in the first track 1. A slide-aiding member 13 is provided between the first track 1 and the second track 2. In this preferred embodiment, the slide-aiding member 13 extends to inner surfaces of the upper and lower lips 12 and includes a plurality of balls 14 to provide a rolling contact between the first track 1 and the second track 2. A stop block 11 is formed on an end of the first track 1 to prevent disengagement of the first track 1 from the third track 3 after the first track 1 is mounted into the third track 3. An engaging member 15 is mounted to the other end of the first track 1. In this embodiment, the first track 1 includes a stub 16 for engaging with a hole 17 of the engaging member 15 and the stub 16 is then riveted. The engaging member 15 further includes two resilient legs 18 that are respectively pressed into two slots 10 in the first track 1, each resilient leg 18 having a hook 19 extending therefrom.

The second track 2 is mounted into the first track 1 and slidable between the upper lip 12 and the lower lip 12. The second track 2 includes holes 21 so as to be fixed to an associated lateral wall of a drawer (not shown). A pressing block 22 and a resilient member 23 are mounted to the second track 2. The pressing block 22 is fixed to the second track 2. In this embodiment, the pressing block 22 is fixed in place by fasteners 24. The pressing block 22 includes a pressing leg 221, two protrusions 222, and a shoulder 223. The pressing leg 221 is used to press the resilient member 23, the protrusion 222 may be engaged with the hooks 19 of the engaging member 15, and the shoulder 223 may abut against an operative wall between each leg 18 and its associated hook 19. An operative wall is defined between each leg 18 and the associated hook 19.

The resilient member 23 is made from resilient material and includes a positioning block 231 on a bottom thereof for engaging with a positioning hole 25 in the second track 2.

An end of the resilient member 23 forms a pressing portion 234, wherein a face of the pressing portion 234 that faces away from the plane of the second track 2 can be pressed. The other end of the resilient member 23 is pressed against by the pressing leg 221 of the pressing block 22. In this embodiment, the resilient member 23 includes a hole 232 for engaging with a distal end of the pressing leg 221. An end of the resilient member 23 that is pressed against by the pressing leg 221 includes a tappet plate 233. The tappet plate 233 pushes the legs 18 of the engaging member 15 when the pressing portion 234 of the resilient member 23 is pressed, such that the operative walls (between the legs 18 and the associated hooks 19) that abut against the shoulder 223 are moved upward, and the hooks 19 are disengaged from the protrusions 222 of the pressing block 22. In order to make the tappet plate 233 protrude slightly beyond a surface of the second track 2, the second track 2 may include a hole 26. In normal state in which the pressing leg 221 presses against the resilient member 23, the tappet plate 233 is located in the hole 26 of the second track 2.

The third track 3 includes holes 31 so as to be nailed to inner lateral wall surfaces of a furniture piece. The third track 3 includes a curved upper longitudinal lip 32 and a curved lower longitudinal lip 32 for preventing disengagement of the first track 1 that slides in the third track 3. In addition, conventional slide-aiding member 33 can be mounted between the third track 3 and the first track 1. A stop block 34 is provided on an end of the third track 3 to cooperate with the stop block 11 of the first track 1, thereby preventing disengagement of the first track 1 from the third track 3 via the end of the third track 3. Another stop block 35 is formed on the other end of the third track 3 to prevent disengagement of the first track 1 from the third track 3 via the other end of the third track 3 after the first track 1 has been mounted into the third track 3.

Figure 2:
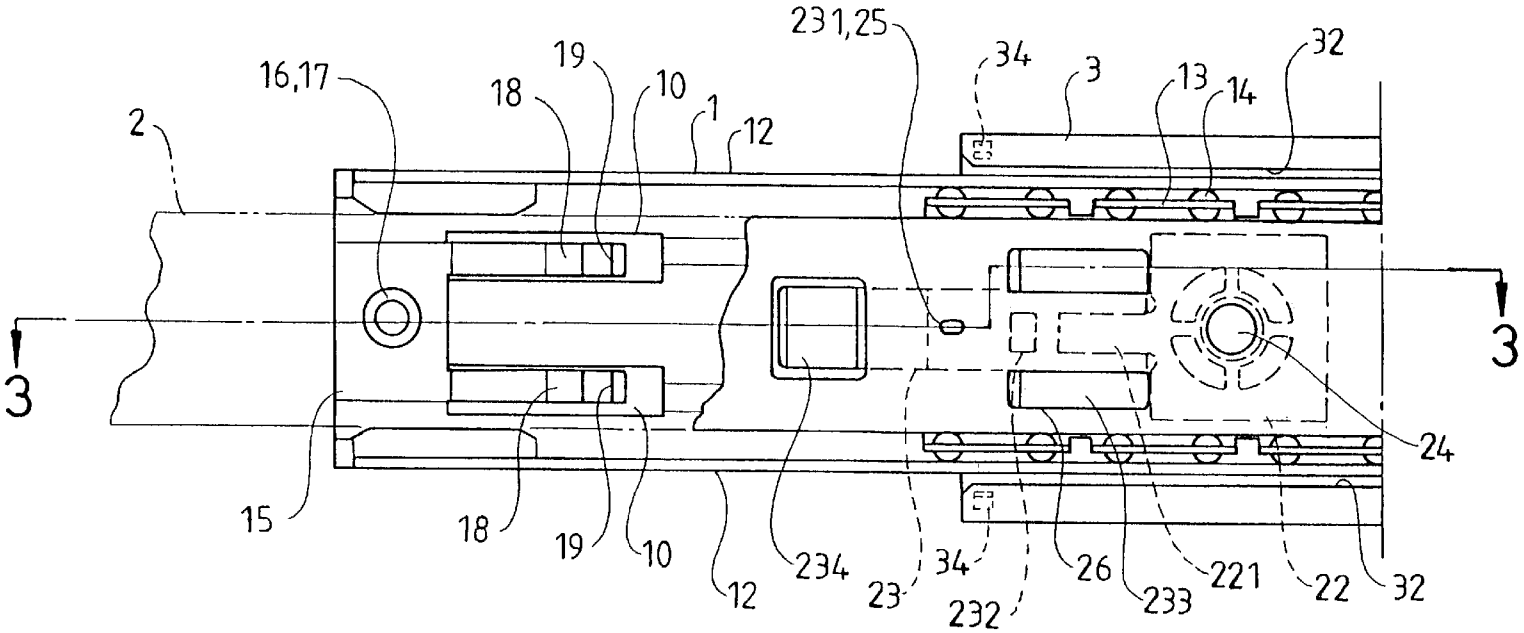
FIG. 2 is a partial top view of a first track and a second track of the track device in accordance with the present invention before engagement.
Figure 3:
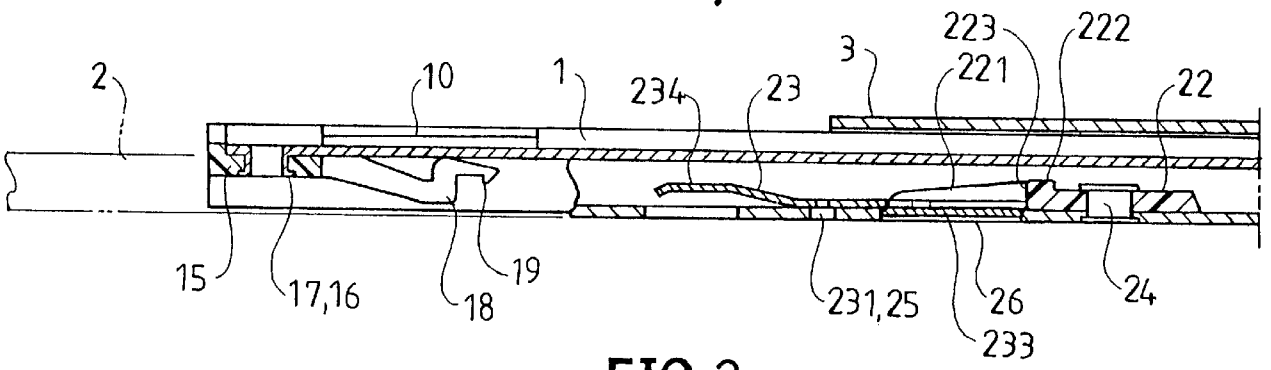
FIG. 3 is a sectional view taken along line 3—3 in FIG. 2.

The first track 1 and the second track 2 in FIGS. 2 and 3 have not engaged with each other, yet. In this state, the engaging member 15 is not engaged with the pressing block 22, the pressing leg 221 of the pressing block 22 presses against the resilient member 23, and the tappet plate 233 is received in the hole 26 of the second track 2.

Figure 4:
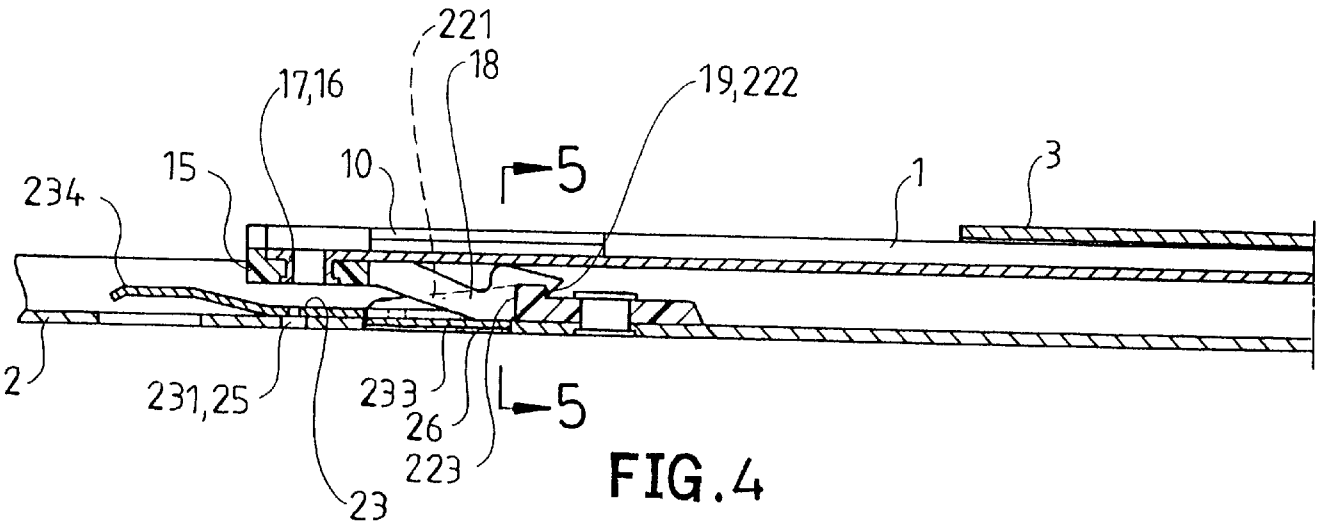
FIG. 4 is a sectional view similar to FIG. 3, wherein the first track and the second track have been engaged with each other.
Figure 5:
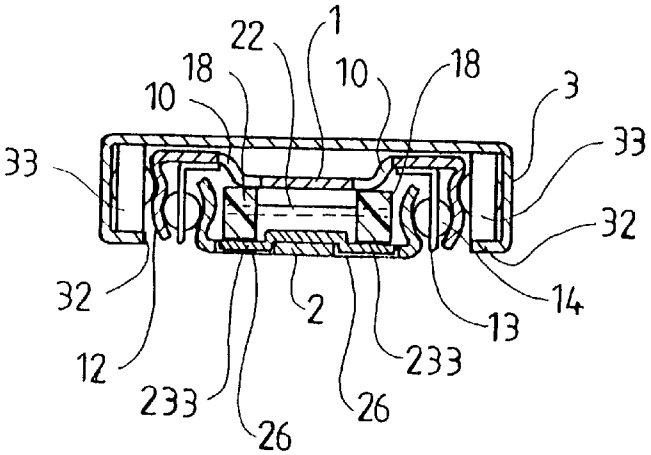
FIG. 5 is a sectional view taken along line 5—5 in FIG. 4.

Referring to FIGS. 4 and 5, when the second track 2 is to be engaged with the first track 1, the former is easily inserted between the lips 12 of the latter. In addition, since each hook 19 of the engaging member 15 has an inclined surface in a distal end thereof, the hook 19 can be easily and smoothly passed over the associated protrusion 222 of the pressing block 22 until the shoulder 223 abuts against the operative walls of the legs 18. The second track 2 is thus engaged with the first track 1. When the hooks 19 are engaged with the protrusions 222, as illustrated in FIG. 4, the second track 2 is in its outermost position with respect to the first track 1; namely, the second track 2 cannot be pulled further outward with respect to the first track 1. When the second track 2 is pushed inward with respect to the first track 1, the engaging force between the hooks 19 and the protrusions 222 is overcome by the inward pushing force. As a result, the protrusions 22 are lifted slightly and moved across the hooks 19. Thus, the second track 2 is retracted into the first track 1.

Figure 6:
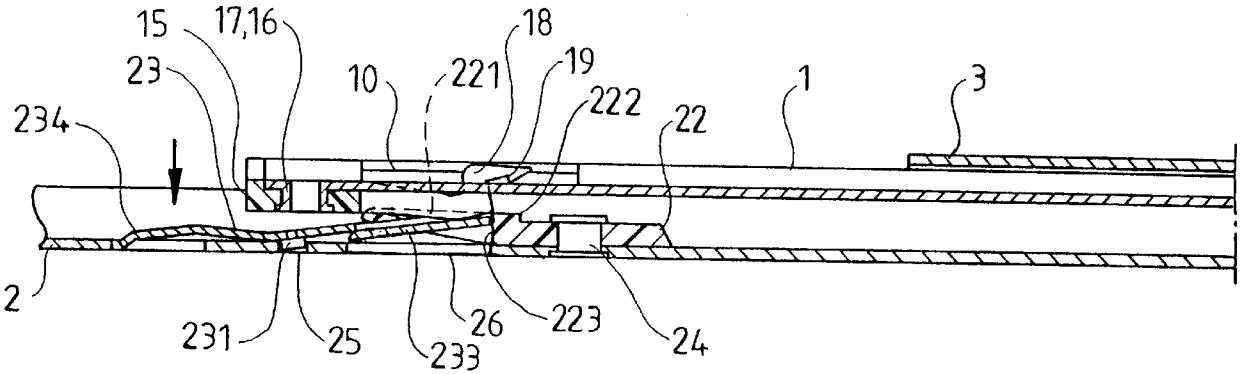
FIG. 6 is a view similar to FIG. 4, wherein a pressing block is pressed.
Figure 7:
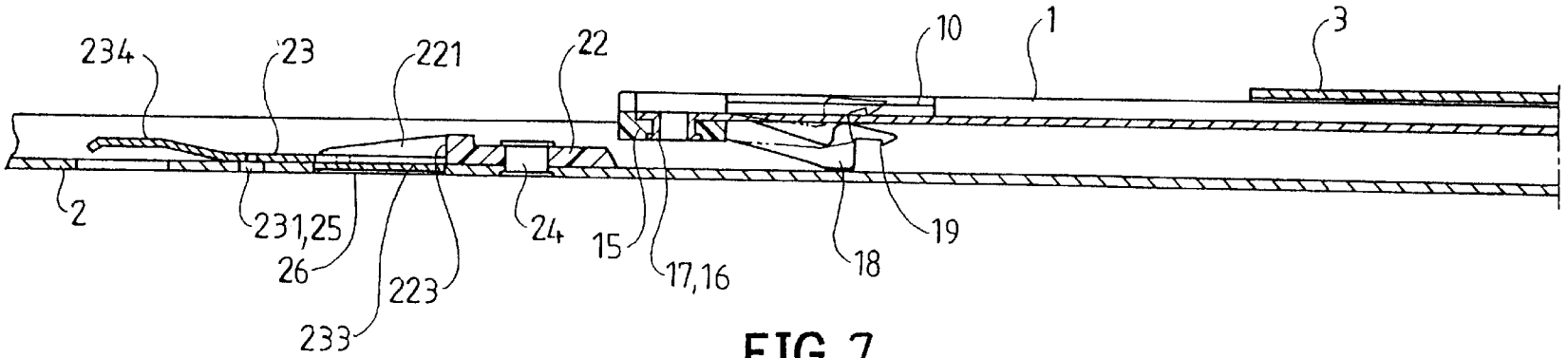
FIG. 7 is a view similar to FIG. 6, wherein the second track is pulled out of the first track.
Figure 8:
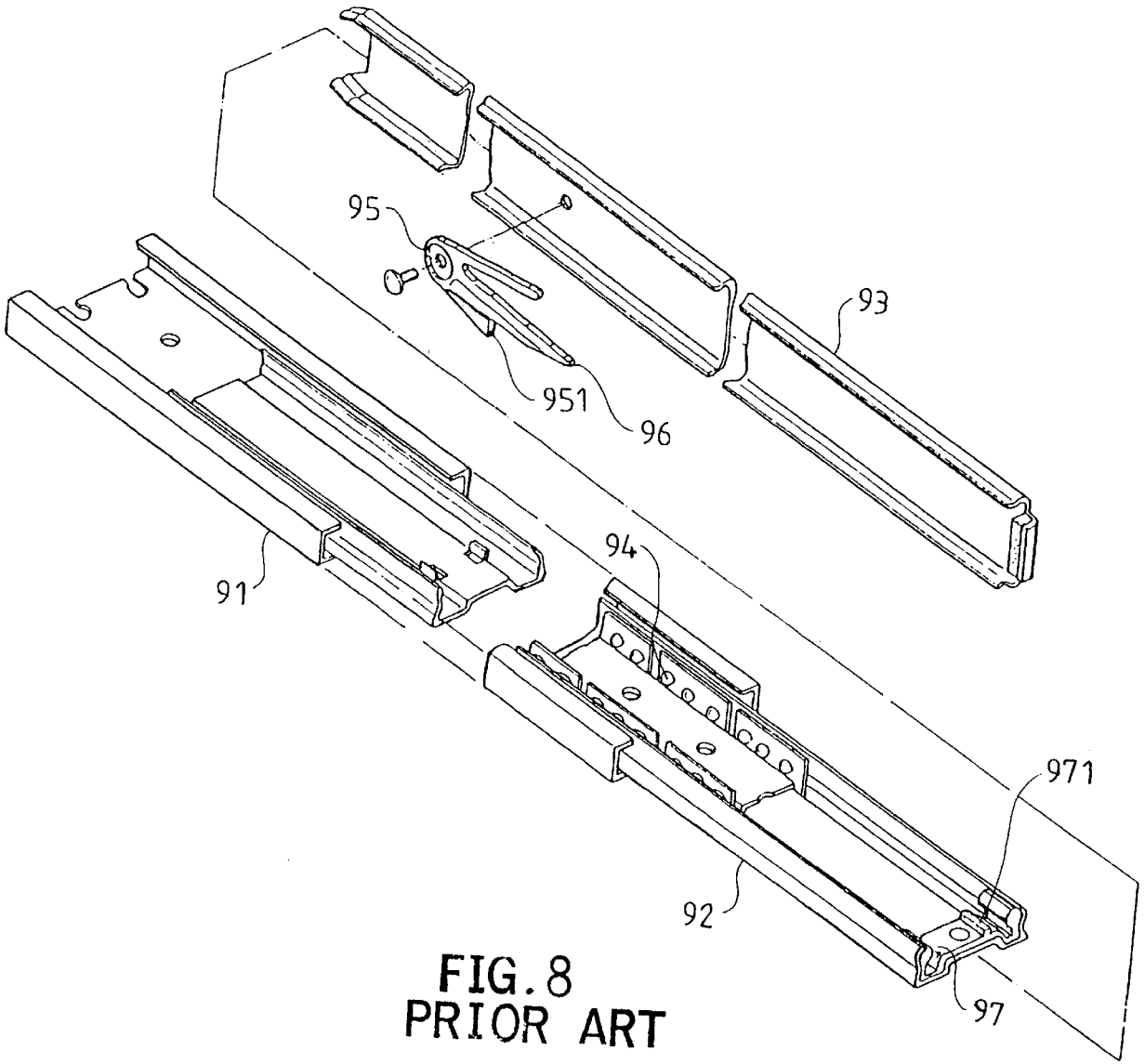
FIG. 8 PRIOR ART
FIG. 8 is an exploded perspective view of a conventional track device for a drawer.

Referring to FIG. 6, when separating the second track 2 from the first track 1, the pressing portion 234 of the resilient member 23 is pressed such that the tappet plate 233 of the resilient member 23 pushes the legs 18 of the engaging member 15. The operative walls of the legs 18 are raised and thus separated from the shoulder 223 of the pressing block 22. Thus, the second track 2 can be pulled outward with respect to the first track 1 and then disengaged from the first track 1, as illustrated in FIG. 7.

According to the above description, it is appreciated that the third track 3 and the first track 1 can be assembled conveniently and quickly as usual. In addition, the second track 2 can also be conveniently and quickly mounted into the first track 1 by means of direct insertion. Furthermore, when the second track 2 is pulled outward to its outermost position, there is no risk of disengagement of the second track 2 from the first track 1 by means of abutting engagement between the operative walls of the legs 18 and the shoulder 223. Further, when the pressing portion 234 of the resilient member 23 is pressed, the legs 28 can be raised and thus separated from the shoulder 223 of the pressing block 22, thereby allowing easy and rapid removal of the second track 2 from the first track 1.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A track device comprising:

a first track including an end, an engaging member being mounted to the end of the first track and including at least one leg and at least one operative wall, the first track further including an upper longitudinal lip and a lower longitudinal lip;

a second track slidably received in the first track and guided between the upper longitudinal lip and the lower longitudinal lip, a pressing block and a resilient member being mounted to the second track, the pressing block including a pressing leg and a shoulder, the pressing leg pressing against an end of the resilient member, the end of the resilient member including a tappet plate, another end of the resilient member including a pressing portion;

wherein the shoulder of the pressing block abutting against said at least one leg of the first track, when the pressing portion of the resilient member is pressed, the tappet plate of the resilient member moves said at least one leg such that said at least one operative wall of the engaging member disengages from the shoulder of the pressing block, thereby allowing separation of the second track from the first track.

2. The track device as claimed in claim 1, wherein the second track includes a hole for receiving the tappet plate of the resilient member.

3. The track device as claimed in claim 1, wherein the first track includes at least one slot for receiving said at least one leg of the engaging member.

4. The track device as claimed in claim 1, wherein said at least one operative wall of the engaging member includes a hook extending therefrom, the pressing block including at least one protrusion, the hook being engaged with said at least one protrusion when the shoulder of the pressing block abuts against said at least one operative wall of the engaging member.

5. A track device comprising:

a first track including an end, an engaging member being mounted to the end of the first track and including at least one leg and at least one operative wall, the first track further including an upper longitudinal lip and a lower longitudinal lip, the first track further including a stop block;

a second track slidably received in the first track and guided between the upper longitudinal lip and the lower longitudinal lip, a pressing block and a resilient member being mounted to the second track, the pressing block including a pressing leg and a shoulder, the pressing leg pressing against an end of the resilient member, the end of the resilient member including a tappet plate, another end of the resilient member including a pressing portion; and a third track including an upper longitudinal lip and a lower longitudinal lip for slidingly receiving the first track, the third track including a stop block provided on an- end thereof for engaging with the stop block of the first block to prevent disengagement of the first track from the third track;

wherein the shoulder of the pressing block abutting against said at least one leg of the first track, when the pressing portion of the resilient member is pressed, the tappet plate of the resilient member moves said at least one leg such that said at least one operative wall of the engaging member disengages from the shoulder of the pressing block, thereby allowing separation of the second track from the first track.

6. The track device as claimed in claim 5, wherein the second track includes a hole for receiving the tappet plate of the resilient member.

7. The track device as claimed in claim 5, wherein the first track includes at least one slot for receiving said at least one leg of the engaging member.

8. The track device as claimed in claim 5, wherein said at least one operative wall of the engaging member includes a hook extending therefrom, the pressing block including at least one protrusion, the hook being engaged with said at least one protrusion when the shoulder of the pressing block abuts against said at least one operative wall of the engaging member.

* * * * *